US009672981B2

(12) United States Patent
Lin et al.

(10) Patent No.: US 9,672,981 B2
(45) Date of Patent: Jun. 6, 2017

(54) METHOD FOR PRODUCING AN R-T-B-M SINTERED MAGNET

(71) Applicants: Xifeng Lin, Yantai (CN); Kaihong Ding, Yantai (CN); Yongjie Wang, Yantai (CN); Shengli Cui, Yantai (CN); Zhong Jie Peng, Yantai (CN); Wenchao Li, Yantai (CN)

(72) Inventors: Xifeng Lin, Yantai (CN); Kaihong Ding, Yantai (CN); Yongjie Wang, Yantai (CN); Shengli Cui, Yantai (CN); Zhong Jie Peng, Yantai (CN); Wenchao Li, Yantai (CN)

(73) Assignee: YANTAI SHOUGANG MAGNETIC MATERIALS INC., Yantai (CN)

( * ) Notice: Subject to any disclaimer, the term of this patent is extended or adjusted under 35 U.S.C. 154(b) by 410 days.

(21) Appl. No.: 14/334,009

(22) Filed: Jul. 17, 2014

(65) Prior Publication Data

US 2015/0023831 A1 Jan. 22, 2015

(30) Foreign Application Priority Data

Jul. 17, 2013 (CN) ..... 2013 1 0299161

(51) Int. Cl.

| | |
|---|---|
| ***B22F 3/24*** | (2006.01) |
| ***H01F 41/02*** | (2006.01) |
| ***H01F 1/057*** | (2006.01) |
| ***H01F 1/053*** | (2006.01) |
| ***C22C 38/00*** | (2006.01) |
| ***C22C 38/06*** | (2006.01) |
| ***C22C 38/10*** | (2006.01) |
| ***C22C 38/16*** | (2006.01) |
| *B22F 3/04* | (2006.01) |
| *B22F 3/12* | (2006.01) |
| *B22F 9/04* | (2006.01) |

(52) U.S. Cl.

CPC ..... *H01F 41/0266* (2013.01); *C22C 38/002* (2013.01); *C22C 38/005* (2013.01); *C22C 38/06* (2013.01); *C22C 38/10* (2013.01); *C22C 38/16* (2013.01); *H01F 1/0536* (2013.01); *H01F 1/0573* (2013.01); *B22F 3/04* (2013.01); *B22F 3/12* (2013.01); *B22F 9/04* (2013.01); *B22F 2003/248* (2013.01); *B22F 2201/02* (2013.01); *B22F 2201/11* (2013.01)

(58) Field of Classification Search

None

See application file for complete search history.

(56) References Cited

U.S. PATENT DOCUMENTS

| | | | | |
|---|---|---|---|---|
| 5,489,343 | A | 2/1996 | Uchida et al. | |
| 5,641,363 | A | 6/1997 | Fukuno et al. | |
| 5,788,782 | A | 8/1998 | Kaneko et al. | |
| 5,834,663 | A | 11/1998 | Fukuno et al. | |
| 5,930,582 | A | 7/1999 | Ito et al. | |
| 6,187,259 | B1 | 2/2001 | Yamashita et al. | |
| 6,344,168 | B1 | 2/2002 | Kuniyoshi | |
| 6,361,738 | B1 | 3/2002 | Kaneko et al. | |
| 6,537,385 | B2 | 3/2003 | Okayama et al. | |
| 6,635,120 | B2 | 10/2003 | Tokoro et al. | |
| 6,746,545 | B2 | 6/2004 | Tamura et al. | |
| 7,056,393 | B2 | 6/2006 | Tokuhara et al. | |
| 7,138,017 | B2 | 11/2006 | Kaneko et al. | |
| 7,255,752 | B2 | 8/2007 | Ishizaka et al. | |
| 7,585,378 | B2 | 9/2009 | Odaka et al. | |
| 7,645,349 | B2 | 1/2010 | Fujimori et al. | |
| 7,955,442 | B2 | 6/2011 | Hidaka et al. | |
| 8,157,927 | B2 | 4/2012 | Enokido et al. | |
| 2005/0028892 | A1* | 2/2005 | Sasaki | B22F 1/0007 148/302 |
| 2006/0165550 | A1 | 7/2006 | Enokido et al. | |
| 2010/0181859 | A1* | 7/2010 | Hirai | H01F 41/0266 310/156.13 |
| 2014/0210580 | A1* | 7/2014 | Peng | H01F 7/02 335/302 |

FOREIGN PATENT DOCUMENTS

| | | | |
|---|---|---|---|
| CN | 102498531 | A | 6/2012 |
| CN | 102534358 | A | 7/2012 |
| CN | 102586682 | A | 7/2012 |
| CN | 102930975 | A | 2/2013 |
| CN | 103093921 | A | 5/2013 |
| EP | 1189244 | A2 | 3/2002 |
| JP | H0917677 | A | 1/1997 |
| JP | 2003234229 | A | 8/2003 |
| JP | 2006019521 | A | 1/2006 |
| JP | 2006210377 | A | 8/2006 |
| JP | 2006299402 | A | 11/2006 |
| JP | 2007329331 | A | 12/2007 |
| JP | 2011211056 | A | 10/2011 |
| WO | 2011004867 | A1 | 1/2011 |
| WO | 2012105399 | A1 | 8/2012 |

OTHER PUBLICATIONS

The State of Intellectual Property Office of People's Republic of China, First Office Action and English Translation, Dated Feb. 2010.

European Search Report, Dated Dec. 22, 2014, Two (2) Pages.

* cited by examiner

*Primary Examiner* — Jessee Roe

*Assistant Examiner* — Ngoclan T Mai

(74) *Attorney, Agent, or Firm* — William H. Honaker; Dickinson Wright PLLC

(57) ABSTRACT

The present invention provides a method for producing an R-T-B-M sintered magnet having an oxygen content of less than 0.07 wt. % from R-T-B-M raw materials. The composition of R-T-B-M includes R being at least one element selected from a rare earth metal including Sc and Y. The composition also includes T being at least one element selected from Fe and Co. B in the composition is defined as Boron. The composition further includes M being at least one element selected from Ti, Ni, Nb, Al, V, Mn, Sn, Ca, Mg, Pb, Sb, Zn, Si, Zr, Cr, Cu, Ga, Mo, W, and Ta. The present invention provides for a step of creating an inert gas environment in the steps of casting, milling, mixing, molding, heating, and aging to prevent the powder from reacting with the oxygen in anyone of the above mentioned steps.

5 Claims, No Drawings

METHOD FOR PRODUCING AN R-T-B-M SINTERED MAGNET

CROSS REFERENCE TO RELATED APPLICATION

This application claims the benefit of a Chinese patent application having a serial number of CN 201310299161.0, published as CN 103377820 A, and filed on Jul. 17, 2013.

BACKGROUND OF THE INVENTION

1. Field of the Invention

The present invention relates to a method for producing an R-T-B-M sintered magnet from R-T-B-M raw materials where R is at least one element selected from rare earth elements including Sc and Y, wherein T is at least one element selected from Fe and Co, wherein B is boron, and wherein M is at least one element selected from Ti, Ni, Nb, Al, V, Mn, Sn, Ca, Mg, Pb, Sb, Zn, Si, Zr, Cr, Cu, Ga, Mo, W, and Ta.

2. Description of the Prior Art

Since the discovery of the sintered Nd—Fe—B permanent magnet by Mr. Sagawa and others in 1983, its fields of application have been continuously expanding. Currently, the fields of application include initial medical magnetic resonance imaging (MRI), voice coil motors (VCM) for hard disk drives, CD Pickup Mechanisms, other medical, and information technologies. The application is also gradually expanding to include fields of energy conservation and environmental protection such as new energy vehicles, generators, wind generators, air conditioning and refrigerator compressors, and lift motors.

Due to increased use of the sintered Nd—Fe—B permanent magnetic materials, rare earth material resources have become scarce. Accordingly, decreasing the usage amount of the rare earth element, especially the heavy rare earth element, has become very important. Such rare earth magnet can be produced by a method as set forth in the Chinese Patent Application ZL01116130.5, published as CN1323045A. The method disclosed in the Chinese Patent Application includes a first step of casting the R-T-B-M raw materials into an alloy sheet. Next, the alloy sheet is subjected to a hydrogen atmosphere in a hydrogen decrepitation process at an absorption pressure to expand and break-up the alloy sheet into powder. The hydrogen is degassed from the hydrogen atmosphere. The next step of the method is injecting the powders into a mill in a stream of inert gas. The powders in the inert gas are milled to produce a mixture of particles. Next, the particles are mixed with a lubricant. After mixing with the lubricant, the particles are molded into a block. The block is subjected to isostatic pressure to the block to increase the density of the block. The block is then heated at a predetermined sintering temperature to further densify the block. After heating the block, the block is aged at a cooler temperature than the predetermined sintering temperature and over a predetermined time to harden the block.

SUMMARY OF THE INVENTION

The invention provides for a method of producing an R-T-B-M sintered magnet from R-T-B-M raw materials including a step of creating an inert gas environment in the steps of casting, milling, mixing, molding, heating, and aging to prevent the alloy powder from reacting with the oxygen in any one of the steps.

Advantages of the Invention

The present invention minimizes the negative effects of oxygen on the properties of the magnet and the coercivity of the magnet is significantly increased.

The present invention solves the problem of performance degradation caused by the high oxygen content in the magnet and it also avoids wasting the rare earth elements in the prior art methods.

The ultrafine rare earth rich powders are not removed in the present invention which facilitates the sintering process and allows the sintering temperature to be lowered.

DESCRIPTION OF THE ENABLING EMBODIMENT

The present invention provides for an R-T-B-M sintered magnet made from an R-T-B-M alloy via a series of processes such as melting, hydrogen decrepitation, milling, molding, sintering, and aging treatment. The processes of hydrogen decrepitation, milling, and molding are protected with inert gas or nitrogen. Oxygen is not added during the milling process. The ultrafine powders which are abundant in rare earth elements are not required to be wiped off. The related R is at least one element selected from rare earth elements including Sc and Y. T is at least one element selected from Fe and Co. B means boron. And M is at least one element selected from Ti, Ni, Nb, Al, V, Mn, Sn, Ca, Mg, Pb, Sb, Zn, Si, Zr, Cr, Cu, Ga, Mo, W, and Ta. The weight percentages of the constituents R-T-B-M are: $29\% \leq R \leq 35\%$, $62\% \leq T \leq 70\%$, $0.1\% \leq M \leq 1.8\%$, $0.9\% \leq B \leq 1.2\%$; and wherein the weight percentage of oxygen in the related magnet is below 0.07%.

The present invention relates to a production method of an R-T-B-M sintered magnet. The method includes a first step of melting the R-T-B-M materials into an alloy. Then conducting hydrogen decrepitation, milling, and molding process under inert or nitrogen environment. And then conducting sintering and aging process. Oxygen is not added during the milling process. The ultrafine of rich rare earth powders do not demand to be wiped off. The above-mentioned sintering process is under vacuum or inert environment with the sintering temperature is between 900~1040° C.

The melting process is performed under an inert or nitrogen environment using an ingot casting or a strip casting process.

In the hydrogen decrepitation process the hydrogen absorption pressure is at least 0.1 MPa and dehydrogenation temperature is between 400~600° C.

The milling process described is a jet milling process, after which the component doesn't change and the particle size is in the range of $X_{50} \leq 8$ μm. The lubricants are mixed into the powders under an inert or nitrogen environment after the jet milling process.

The molding process is under an inert or nitrogen environment, relating to two steps of mould pressing and isostatic pressing. DC magnetic field is used as the magnetizing magnetic field during the mould pressing process. The magnetic field intensity is between 1.5~2.5 T. The density of the block is between 3.5~4.5 g/cm$^3$ after the mould pressing. Isostatic pressing is conducted when the mould pressing has been finished. The pressure of the isostatic pressing is between 100~300 Mpa. The density of the block magnifies to 4.0~5.0 g/cm$^3$ after the isostatic pressing process.

The aging process is under an inert or nitrogen environment. The temperature of first aging is between 800~900° C., and the temperature of second aging is between 400~600° C.

The present invention provides an improved method of producing an R-T-B-M sintered magnet.

Example 1

Implementing Examples 1 and 2 are listed below to illustrate the effects of reducing the oxygen content. They are manufactured by using the following steps:

Melting: Metal or alloy raw materials are heated under an argon atmosphere. The raw materials comprises of R including Neodymium being present in the amount of 23.6 wt. %, Praseodymium being present in the amount of 5.9 wt. %, and Dysprosium being present in the amount of 3 wt. %. The raw material also includes T having Iron being present in the amount of 64.95 wt. % and Cobalt being present in the amount of 1 wt. %. In addition, the raw material includes Boron being present in the amount of 1.15 wt. %. The raw materials further includes M having Aluminum being present in the amount of 0.3 wt. % and Copper being present in the amount of 0.1 wt. %. The raw materials are manufactured into alloy sheets via a strip casting process and the alloy sheets are labeled as implementing examples 1 and 2, respectively. The total amount of rare earth elements contained in the alloy sheets is 31.9 wt. %.

Hydrogen decrepitation: The alloy sheets first absorb hydrogen under a hydrogen absorption pressure of 0.2 MPa. Then, the hydrogen is removed via vacuum under a temperature of 500° C. After the Hydrogen Decrepitation process, the powder labeled as implementing example 1 is stored in an airtight container protected under argon and powder labeled as implement example 2 is stored in an airtight container protected under nitrogen.

Milling process: The powders of implementing example 1 are milled under high pressure argon and the powders of implementing example 2 are milled under high pressure until the average particle size reaches 5.0 μm ($X_{50}$=5.0 μm). During the milling process, oxygen is not introduced into the jet mill. In addition, the ultrafine powders are not removed during the milling process. Conventional lubricants are mixed with the powders of implementing examples 1 and 2 after the jet milling process by using a blender mixer under argon and nitrogen gas, respectively. The mixed powder for implementing example 1 is stored in an airtight container protected under argon. The mixed powder for implementing example 2 is stored in an airtight container protected under nitrogen.

Molding: The powder for implementing example 1 is molded under an argon gas environment and the powder for implementing example 2 is molded under nitrogen as environment. During the molding process, the powders are oriented under a DC magnetic field having a magnetic strength of 2.0 T. The density of the blocks obtained after the molding process is 3.6 g/cm$^3$. The blocks are then subjected to an isostatic pressing process under a pressure of 200 MPa to increase the density of the blocks to 4.3 g/cm$^3$.

Sintering: The blocks made from the powders of implementing examples 1 and 2 are heated to and maintained at a temperature of at least 400° C. under vacuum. The temperature is then increased to 1000° C. to sinter the blocks under vacuum.

Aging (or curing treatment): After the sintering process, the magnets are subjected to an curing treatment under argon gas environment. The curing treatment includes a first step of being at a temperature of 850° C. followed by a second step of being at a temperature of 450° C. After the curing treatment, the magnets are processed into two samples for the implement examples 1 and 2 and each of the magnets having a length of 10 mm and a height of 10 mm.

Comparative examples 1, 2, 3 are manufactured using the following method:

Melting: Metal or alloy raw materials are heated under an argon atmosphere. The raw materials comprises of R including Neodymium being present in the amount of 23.6 wt. %, Praseodymium being present in the amount of 5.9 wt. %, and Dysprosium being present in the amount of 3 wt. %. The raw materials also includes T having iron being in the amount of 64.95 wt. % and Cobalt being in the amount of 1 wt. %. In addition, the raw material includes Boron being present in the amount of 1.15 wt. %. The raw material further includes M having Aluminum being present in the amount of 0.3 wt. % and Copper being in the amount of 0.1 wt. %. The raw materials are manufactured into alloy sheets via a strip casting process and labeled the alloy sheets are labeled as comparative examples 1, 2, and 3. The total amount of rare earth elements contained in the alloy sheets is 31.9 wt. %.

Hydrogen Decrepitation: The alloy sheets first absorb hydrogen under a hydrogen absorption pressure of 0.2 MPa. Then, the hydrogen is removed via vacuum under a temperature of 500° C. After the decrepitation process, the powders are stored in separate containers protected under argon.

Milling process: the powders are milled under high pressure argon the average particle size reaches 5.0 μm ($X_{50}$=5.0 μm). During the milling process, oxygen of 0.01%, 0.02% and 0.04% in volume fraction are separately introduced into the jet mill. In addition, ultrafine powders are not removed during the milling process to make powders for comparative examples 1, 2, and 3, respectively. Conventional lubricants are mixed with the powders of comparative examples 1, 2, and 3 by using a blender mixer under argon gas. The mixed powders are stored in separate containers protected under argon.

Molding: the powders for comparative examples 1, 2, and 3 are molded under an argon gas environment. During the molding process, the powders are oriented under a DC magnetic field having a magnetic strength of 2.0 T. The density of the blocks obtained after the molding process is 3.6 g/cm$^3$. The blocks are then subjected to an isostatic pressing process under a pressure of 200 MPa to increase the density of the blocks to 4.3 g/cm$^3$.

Sintering: The blocks made from the powders of comparative examples 1, 2, and 3 are heated to and maintained at a temperature of at least 400° C. under vacuum. The temperature is then increased to 1000° C. to sinter the blocks under vacuum.

Aging (or curing treatment): After the sintering process, the magnets of comparative examples 1, 2, and 3 are subjected to a curing treatment under argon gas environment. The curing treatment includes a first step of being at a temperature of 850° C. followed by a second step of being at a temperature of 450° C. After the curing treatment, the magnets are processed into three samples for the comparative examples 1, 2, and 3 and each of the magnets having a length of 10 mm and a height of 10 mm.

The magnetic properties and composition analysis results of the implementing examples 1, 2 and comparative examples 1, 2, 3 are listed in Table 1 below.

TABLE 1

Comparison of Results under Different Milling Environments

| | Processes | | | | Sheet Comp. | Magnet Comp. | | Magnet Performance | | | |
|---|---|---|---|---|---|---|---|---|---|---|---|
| | O vol. % | Ultrafine Powders | Milling Gas | Sintering Temp. (° C.) | Σ Re wt. % | Σ Re wt. % | O wt. % | Br (KGs) | Hcj (kOe) | BHa (MGOe) | g/cm$^3$ |
| Implementing Example 1 | 0 | Incl. | Ar | 1000 | 31.9 | 31.9 | 0.05 | 12.8 | 20.3 | 40.3 | 7.54 |
| Comparative Example 2 | 0 | Incl. | $N_2$ | 1000 | 31.9 | 31.9 | 0.05 | 12.8 | 19.8 | 40.0 | 7.51 |
| Implementing Example 1 | 0.01 | Incl. | Ar | 1000 | 31.9 | 31.9 | 0.10 | 12.7 | 19.7 | 39.5 | 7.47 |
| Comparative Example 2 | 0.02 | Incl. | Ar | 1000 | 31.9 | 31.9 | 0.15 | 12.5 | 19.2 | 38.6 | 7.39 |
| Comparative Example 3 | 0.04 | Incl | Ar | 1000 | 31.9 | 31.9 | 0.25 | 12.3 | 18.0 | 36.9 | 7.24 |

As indicated by Table 1, the addition of oxygen will reduce the density of the sintered magnets. Compared to the sintered magnet set forth in Implementing Example 1, densities of the comparative examples 1, 2, and 3 are lower by 0.07 g/cm$^3$, 0.15 g/cm$^3$, and 0.30 g/cm$^3$, respectively. Compared to the sintered magnet set forth in Implementing Example 2, densities of the Comparative Examples 1, 2, and 3 are lower by 0.04 g/cm$^3$, 0.12 g/cm$^3$, 0.27 g/cm$^3$, respectively. As a result of the decrease in density, the remanence and magnetic energy of the sintered magnets are also lowered. Compared with the sintered magnets in the Implementing Examples 1 and 2, the remanence of the comparative examples 1, 2, and 3 are reduced by 0.1 KGs, 0.3 KGs, and 0.5 KGs, respectively. Compared to the sintered magnet as set forth in the Implementing Example 1, the magnetic energy of the sintered magnets in the Comparative Examples 1, 2, and 3 are lowered by 0.8 MGOe, 1.7 MGOe, and 3.4 MGOe, respectively. Compared to the sintered magnets as set forth in the Implementing Example 2, the magnetic energy of the sintered magnets in the Comparative Examples 1, 2, and 3 are reduced by 0.5 MGOe, 1.4 MGOe, and 3.1 MGOe, respectively. Because portions of the rare earth rich phase in the Comparative Examples 1, 2, and 3 are oxidized, the coercivity of the sintered magnets are also affected. Specifically, compared to the sintered magnet as set forth in the Implementing Example 1, the coercivity of the sintered magnets in the Comparative Examples 1, 2, and 3 are reduced by 0.6 KOe, 1.1 KOe, and 2.3 KOe, respectively. Compared to the sintered magnet as set forth in the Implementing Example 2, the coercivity of the sintered magnets in the Comparative Examples 1, 2, and 3 are reduced by 0.1 KOe, 0.6 KOe, and 1.8 KOe, respectively.

Example 2

Implementing Examples 3 and 4 are used to illustrate the effect of not removing the ultrafine powders. They are manufactured by using the following steps:

Melting: Metal or alloy raw materials are heated under vacuum. The raw materials comprises of R including Neodymium being present in an amount of 22.4 wt. %, Praseodymium being present in an amount of 5.6 wt. %, and Terbium being present in an amount of 2 wt. %. The raw material also includes T having Iron being present in an amount of 67.85 wt. % and Cobalt being present in an amount of 1 wt. %. In addition, the raw material includes Boron being present in an amount of 0.95 wt. %. The raw material further includes M having Aluminum being present in an amount of 0.1 wt. % and Copper being present in an amount of 0.1 wt. %. The raw materials are manufactured into alloy sheets via a strip casing process and labeled as Implementing Examples 1 and 2, respectively. The total amount of rare earth elements contained in the alloy sheets is 29.3 wt. %

Hydrogen Decrepitation: The alloys sheets first absorb hydrogen under a hydrogen absorption pressure of 0.2 MPa. Then, the hydrogen is removed via vacuum under a temperature of 500° C. After the Hydrogen Decrepitation process, the powder labeled as comparative example 3 is stored in an airtight container protected under argon and powder labeled as implement example 4 is stored in an airtight container protected under nitrogen.

Milling process: The powders of implementing example 3 are milled under high pressure argon and the powders of implementing example 4 are milled under high pressure nitrogen until the average particle size reaches 5.0 μm ($X_{50}$=5.0 μm). During the milling process, oxygen is not introduced into the jet mill. In addition, the ultrafine powders are not removed during the milling process. Conventional lubricants are mixed with the powders of implementing examples 3 and 4 after the jet milling process by using a blender mixer under argon and nitrogen gas, respectively. The mixed powder for implementing example 3 is stored in an airtight container protected under argon. The mixed powder for implementing example 4 is stored in an airtight container protected under nitrogen.

Molding: The powder for implementing example 3 is molded under an argon gas environment and the powder for implementing example 4 is molded under nitrogen as environment. During the molding process, the powders are oriented under a DC magnetic field having a magnetic strength of 2.0 T. The density of the blocks obtained after the molding process is 4.0 g/cm$^3$. The blocks are then subjected to an isostatic pressing process under a pressure of 200 MPa to increase the density of the blocks to 4.5 g/cm$^3$.

Sintering: The blocks made from the powders of Implementing Examples 3 and 4 are heated to and maintained at a temperature of at least 400° C. under vacuum. The temperature is then increased to 1000° C. to sinter the blocks under the vacuum.

Aging (or curing treatment): After the sintering process, the magnets of implementing examples 3 and 4 are subjected to a curing treatment under argon gas environment. The curing treatment includes a first step of being at a temperature of 850° C. followed by a second step of being at a temperature of 450° C. After the curing treatment, the magnets are processed into two samples for the implementing examples 3 and 4, respectively, each having a length of 10 mm and a height of 10 mm.

The manufacturing methods for comparative examples 4 and 5 are as follows:

Melting: Metal or alloy raw materials are heated under vacuum. The raw materials comprises of R including Neodymium being present in an amount of 22.4 wt. %, Praseodymium being present in an amount of 5.6 wt. %, and Terbium being present in an amount of 2 wt. %. The raw material also includes T having Iron being present in an amount of 67.85 wt. % and Cobalt being present in an amount of 1 wt. %. In addition, the raw material includes Boron being present in an amount of 0.95 wt. %. The raw material further includes M having Aluminum being present in an amount of 0.1 wt. % and Copper being present in an amount of 0.1 wt. %. The raw materials are manufactured into alloy sheets via a strip casing process and labeled as Comparative Examples 4 and 5, respectively. The total amount of rare earth elements contained in the alloy sheets is 29.3 wt. %.

Hydrogen Decrepitation: The alloys sheets first absorb hydrogen under a hydrogen absorption pressure of 0.2 MPa. Then, the hydrogen is removed via vacuum under a temperature of 500° C. After the Hydrogen Decrepitation process, the powder labeled as comparative example 4 is stored in an airtight container protected under argon and powder labeled as comparative example 5 is stored in an airtight container protected under nitrogen.

Milling process: The powders of comparative example 4 are milled under high pressure argon and the powders of comparative example 5 are milled under high pressure nitrogen until the average particle size reaches 5.0 μm ($X_{50}$=5.0 μm). During the milling process, oxygen is not introduced into the jet mill. In addition, the ultrafine powders are removed during the milling process by using a cyclone separator. Conventional lubricants are mixed with the powders of comparative example 4 under argon and comparative example 5 under nitrogen gas by using a blender mixer. The mixed powder for comparative example 4 is stored in an airtight container and protected under argon. The mixed powder for comparative example 5 is stored in an airtight container protected under nitrogen.

Molding: the powders for comparative example 4 are molded under an argon environment and the powders for comparative example 5 are molded under nitrogen environment. During the molding process, the powders are oriented under a DC magnetic field having a magnetic strength of 2.0 T. The density of the blocks obtained after the molding process is 4.0 g/cm$^3$. The blocks are then subjected to an isostatic pressing process under a pressure of 200 MPa to increase the density of the blocks to 4.5 g/cm$^3$.

Sintering: The blocks made from the powders of comparative examples 4 and 5 are heated to and maintained at a temperature of at least 400° C. under vacuum. The temperature is then increased to 1000° C. to sinter the blocks under the vacuum.

Aging (or curing treatment): after the sintering process the magnets of comparative examples 4 and 5 are subjected to a curing treatment under argon gas environment. The curing treatment includes a first step of being at a temperature of 850° C. followed by a second step of being at a temperature of 450° C. After the curing treatment, the magnets are processed into two samples for the comparative examples 4 and 5, respectively, each having a length of 10 mm and a height of 10 mm.

The magnetic properties and composition analysis results of the implementing examples 3 and 4 and comparative examples 4 and 5 are listed in Table 2 below.

TABLE 2

Comparison of Results under Different Milling Environments

| | Processes | | | | Sheet Comp. | Magnet Comp. | | Magnet Performance | | | | Particle Size |
|---|---|---|---|---|---|---|---|---|---|---|---|---|
| | O vol. % | Ultrafine Powders | Milling Gas | Sintering Temp. (° C.) | Σ Re wt. % | Σ Re wt. % | O wt. % | Br (KGs) | Hcj (kOe) | BHa (MGOe) | g/cm$^3$ | $X_{50}$ μm |
| Implementing Example 3 | 0 | Inc. | Ar | 1030 | 29.3 | 29.3 | 0.03 | 14.3 | 17.3 | 49.8 | 7.52 | 5.0 |
| Comparative Example 4 | 0 | Remove | Ar | 1030 | 29.3 | 28.8 | 0.03 | 14.3 | 16.3 | 49.8 | 7.48 | 5.0 |
| Implementing Example 4 | 0 | Inc. | $N_2$ | 1030 | 29.3 | 29.3 | 0.03 | 14.2 | 16.2 | 49.2 | 7.48 | 5.0 |
| Comparative Example 5 | 0 | Remove | $N_2$ | 1030 | 29.3 | 28.8 | 0.03 | 14 | 15.2 | 49.2 | 7.4 | 5.0 |

As indicated by Table 2, regardless using argon or nitrogen gas, the coercivity of the magnets is decreased if the ultrafine powders are removed. Comparing the comparative example 4 with implementing example 3, the coercivity of the comparative example 4 is lower than the coercivity of the implementing example by 1 KOe. Comparing the comparative example 5 with implementing example 4, the coercivity of the comparative example 5 is lower than the coercivity of the implementing example by 1 KOe. This is caused by the removal of the ultrafine powders. The ultrafine powders removed contains a large amount of rare earth elements, by removing the ultrafine powders, the rare earth rich phase of the magnet is decreased, thereby affecting the coercivity of the magnet.

Example 3

Implementing Example 5 is used to illustrate the effect of lowering the sintering temperature. They are manufactured by using the following steps:

Melting: Metal or alloy raw materials are heated under an argon atmosphere. The raw materials comprises of R including Neodymium being present in an amount of 20.8 wt. %, Praseodymium being present in an amount of 5.2 wt. %, Dysprosium being present in an amount of 3 wt. %, and Terbium being present in an amount of 2 wt. %. The raw materials also include T having Iron being present in an amount of 65.8 wt. % and Cobalt being present in an amount of 1 wt. %. In addition, the raw materials include Boron being present in an amount of 1.05 wt. %. The raw materials further include M having Aluminum being present in an amount of 1 wt. % and Copper being present in an amount of 0.15 wt. %. The raw materials are manufactured into alloy sheets via a strip casing process and labeled as implementing example 5. The total amount of rare earth elements contained in the alloy sheets is 30.2 wt. %.

Hydrogen Decrepitation: the alloy sheets first absorb hydrogen under a hydrogen absorption pressure of 0.2 MPa. Then, the hydrogen is removed via vacuum under a temperature of 500° C. After the hydrogen decrepitation process, the powder is stored in an airtight container protected under nitrogen.

Milling process: the powders of the implementing example 5 are milled under high pressure nitrogen until the average particle size reaches 5.0 μm ($X_{50}$=5.0 μm). During the milling process, oxygen is not introduced into the jet mill. In addition, the ultrafine powders are not removed during the milling process. Conventional lubricants are mixed with the powders of the implementing example 5 by using a blender mixer under nitrogen gas. The mixed powder for the implementing example 5 is stored in an airtight container protected under nitrogen.

Molding: the powders for the implementing example 5 are molded under a nitrogen gas environment. During the molding process, the powders are oriented under a DC magnetic field having a magnetic strength of 2.0 T. The density of the blocks obtained after the molding process is 4.0 g/cm$^3$. The blocks are then subjected to an isostatic pressing process under a pressure of 200 MPa to increase the density of the blocks to 4.5 g/cm$^3$.

Sintering: the blocks made from the powders of the implementing example 5 are heated to and maintained at a temperature of at least 400° C. under vacuum. The temperature is then increased to 1010° C. to sinter the blocks under the vacuum.

Aging (or curing treatment): after the sintering process, the magnets of the implementing example 5 are subjected to a curing treatment under a nitrogen gas environment. The curing treatment includes a first step of being at a temperature of 850° C. followed by a second step of being at a temperature of 450° C. After the curing treatment, the magnets are processed into samples for the implementing example 5 having a length of 10 mm and a height of 10 mm.

Comparative examples 6 and 7 are manufactured by the following steps:

Melting: Metal or alloy raw materials are heated under an argon atmosphere. The raw materials comprise of R including Neodymium being present in an amount of 20.8 wt. %, praseodymium being presenting in an amount of 5.2 wt. %, Dysprosium being present in an amount of 3 wt. %, Terbium being present in an amount of 2 wt. %. The raw materials also include T having Iron being present in an amount of 65.8 wt. % and Cobalt being present in an amount of 1 wt. %. In addition, the raw materials include Boron being present in an amount of 1.05 wt. %. The raw materials further include M having Aluminum being present in an amount of 1.0 wt. % and Copper being present in an amount of 0.15 wt. %. The raw materials are manufactured into alloy sheets via a strip casting process and labeled as comparative examples 6 and 7, respectively. The total amount of rare earth elements contained in the alloy sheets is 30.2 wt. %.

Hydrogen Decrepitation: the alloy sheet first absorbs hydrogen under a hydrogen absorption pressure of 0.2 MPa. then, the hydrogen is removed via vacuum under a temperature of 500° C. After the hydrogen decrepitation process, the powders are separately stored in airtight containers protected under nitrogen.

Milling process: the powders of the comparative examples 6 and 7 are milled by using high pressure nitrogen until the average particle size reaches 5.0 μm ($X_{50}$=5.0 μm). During the milling process, oxygen is not introduced into the jet mill. The ultrafine powders are removed during the milling process by using a cyclone separator. Conventional lubricants are mixed with the powders of the comparative examples 6 and 7 by using a blender mixer under nitrogen gas. The mixed powders for the comparative examples 6 and 7 are separately stored in airtight containers protected under nitrogen.

Sintering: the blocks made from powders of the comparative examples 6 and 7 are heated to and maintained at a temperature of at least 400° C. under vacuum. For the comparative example 6, the temperature is increased to 1010° C. to sinter the blocks under the vacuum. For the comparative example 7, the temperature is increased to 1020° C. to sinter the blocks under the vacuum.

Aging (or curing treatment): after the sintering process, the magnets of the comparative examples 6 and 7 are subjected to a curing treatment under an inert gas environment. The curing treatment includes a first step of being at a temperature of 850° C. followed by a second step of being at a temperature of 450° C. After the curing treatment, the magnets are processed into two samples for the comparative examples 6 and 7, respectively, each having a length of 10 mm and a height of 10 mm.

The magnetic properties and composition analysis results of the implementing examples 5 and comparative examples 6 and 7 are listed in Table 3 below:

TABLE 3

Comparison of Results Under Different Sintering Temperatures

| | Processes | | | | Sheet | Magnet | | | | | |
|---|---|---|---|---|---|---|---|---|---|---|---|
| | | | | Sintering | Comp. | Comp. | | Magnet Performance | | | |
| | O vol. % | Ultrafine Powders | Milling Gas | Temp. (° C.) | Σ Re wt. % | Σ Re wt. % | O wt. % | Br (KGs) | Hcj (kOe) | BHa (MGOe) | g/cm$^3$ |
| Implementing Example 5 | 0 | Yes | $N_2$ | 1010 | 30.2 | 30.2 | 0.05 | 12.3 | 28.5 | 37.3 | 7.58 |

TABLE 3-continued

Comparison of Results Under Different Sintering Temperatures

| | Processes | | | | Sheet Comp. | Magnet Comp. | | Magnet Performance | | | |
|---|---|---|---|---|---|---|---|---|---|---|---|
| | O vol. % | Ultrafine Powders | Milling Gas | Sintering Temp. (° C.) | Σ Re wt. % | Σ Re wt. % | O wt. % | Br (KGs) | Hcj (kOe) | BHa (MGOe) | g/cm$^3$ |
| Comparative Example 6 | 0 | No | $N_2$ | 1010 | 30.2 | 29.7 | 0.05 | 12.2 | 27.6 | 36.2 | 7.45 |
| Comparative Example 7 | 0 | No | $N_2$ | 1020 | 30.2 | 29.7 | 0.05 | 12.3 | 27.6 | 37.2 | 7.55 |

As illustrated in Table 3, using nitrogen and removing the ultrafine powders during the during the jet milling process, under the same sintering temperature, the density of the magnet in comparative example 6 is 0.13 g/cm$^3$ lower than the density of the magnet in implementing example 5. Through increasing the sintering temperature by 10° C., the magnet in the comparative example 7 is able to reach the same density as the magnet in the implementing example 5. However, the coercivity of the comparative example 7 is 0.9 KOe lower than the coercivity of the implementing example 5.

Example 4

Implementing Examples 6 and 7 are used to illustrate the effect of different magnetic composition. Implementing Example 6 is manufactured by using the following steps:

Melting: Metal or alloy raw materials are heated under an argon atmosphere. The raw materials comprise of R including Neodymium being present in an amount of 23.2 wt. % and Praseodymium being resent in an amount of 5.8 wt. %. The raw materials also include T having Iron being present in an amount of 69 wt. % and Cobalt being present in an amount of 1 wt. %. In addition, the raw materials include Boron being present in an amount of 0.9 wt. %. The raw materials further include M having Copper being present in an amount of 0.1 wt. %. The raw materials are manufactured into alloy sheets for the implementing example 6 via a strip casting process. The total amount of rare earth elements contained in the alloy sheets is 28.5 wt. %.

Hydrogen Decrepitation: the alloy sheet first absorbs hydrogen under a hydrogen absorption pressure of 1.0 MPa. Then, the hydrogen is removed via vacuum under a temperature of 600° C. After the hydrogen decrepitation process, the powders are separately stored in an airtight containers protected under argon.

Milling process: the powders of the implementing example 6 are milled by using high pressure argon until the average particle size reaches 8.0 μm (X50=8.0 μm). During the milling process, oxygen is not introduced into the jet mill. In addition, the ultrafine powders are not removed during the milling process. Conventional lubricants are mixed with the powders of the implementing example 6 by using a blender mixer under argon gas. The mixed powders for the implementing examples 6 are stored in airtight containers protected under argon.

Molding: the powders for the implementing example 6 are molded under an argon gas environment. During the molding process, the powders are oriented under a DC magnetic field having a magnetic strength of 1.5 T. The density of the blocks obtained after the molding process is 4.5 g/cm$^3$. The blocks are then subjected to an isostatic pressing process under a pressure of 300 MPa to increase the density of the blocks to 5.0 g/cm$^3$.

Sintering: The blocks made from powders of the Implementing Example 6 are heated to and maintained at a temperature of at least 400° C. under vacuum. The temperature is then increased to 1040° C. to sinter the blocks under the vacuum.

Aging (or curing treatment): after the sinter process, the magnets of the implementing example 6 are subjected to a curing treatment under an inert gas environment. The curing treatment includes a first step of being at a temperature of 900° C. followed by a second step of being at a temperature of 600° C. After the curing treatment, the magnets are processed into samples for implementing example 6 having a length of 10 mm and a height of 10 mm.

Implementing Example 7 is manufactured by using the following steps:

Melting: metal or alloy raw materials are heated under an argon atmosphere. The raw materials comprise of R including Neodymium being present in an amount of 26.4 wt. %, Praseodymium being present in an amount of 6.6 wt. %, Dysprosium being present in an amount of 1 wt. %, and Terbium being present in an amount of 1 wt. %. The raw materials also include T having Iron being present in an amount of 62 wt. %. In addition, the raw materials include Boron being present in an amount of 1.2 wt. %. The raw materials further include M of having Aluminum being present in an amount of 1.3 wt. %, Copper being present in an amount of 0.2 wt. %, Gallium being present in an amount of 0.3 wt. %. The raw materials are manufactured into alloy sheets for the implementing example 7 via a strip casting process. The total amount of rare earth elements contained in the alloy sheets is 34.3 wt. %.

Hydrogen Decrepitation: the alloy sheet first absorbs hydrogen under a hydrogen absorption pressure of 0.11 MPa. Then, the hydrogen is removed via vacuum under a temperature of 400° C. After the hydrogen decrepitation process, the powders are separately stored in an airtight container protected under argon.

Milling process: the powders of the implementing example 7 are milled by using high pressure argon until the average particle size reaches 2.0 μm (X50=2.0 μm). During the milling process, oxygen is not introduced into the jet mill. In addition, the ultrafine powders are not removed during the milling process. Conventional lubricants are mixed with the powders of the implementing example 7 by using a blender mixer under argon gas. The mixed powders for the implementing example 7 are stored in airtight containers protected under argon.

Molding: the powders for the implementing example 6 are molded under an argon gas environment. During the molding process, the powders are oriented under a DC magnetic field having a magnetic strength of 2.5 T. The density of the blocks obtained after the molding process is 3.5 g/cm$^3$. The blocks are then subjected to an isostatic pressing process under a pressure of 100 MPa to increase the density of the blocks to 4.0 g/cm$^3$.

Sintering: the blocks made from powders of the Implementing Example 7 are heated to and maintained at a temperature of at least 400° C. under vacuum. The temperature is then increased to 900° C. under the vacuum.

Aging (or curing treatment): after the sintering process, the magnets of the implementing example 7 are subjected to a curing treatment under an inert gas environment. The curing treatment includes a first step of being at a temperature of 800° C. followed by a second step of being at a temperature of 400° C. After the curing treatment, the magnets are processed into samples for implementing example 7 having a length of 10 mm and a height of 10 mm.

TABLE 4

Results of magnets in different composition

| | Processes | | | | Sheet Comp. | Magnet Comp. | | Magnet Performance | | | |
|---|---|---|---|---|---|---|---|---|---|---|---|
| | O vol. % | Ultrafine Powders | Milling Gas | Sintering Temp. (° C.) | Σ Re wt. % | Σ Re wt. % | O wt. % | Br (KGs) | Hcj (kOe) | BHa (MGOe) | g/cm$^3$ |
| Implementing Example 6 | 0 | No | Ar | 1020 | 28.5 | 28.5 | 0.02 | 14.8 | 10.8 | 53.5 | 7.5 |
| Implementing Example 7 | 0 | No | Ar | 990 | 34.3 | 34.3 | 0.07 | 11.4 | 26.8 | 32.1 | 7.45 |

The present invention provides a method for producing an R-T-B-M sintered magnet having an oxygen content of less than 0.07 wt. % from R-T-B-M raw materials. The composition of R-T-B-M includes R being at least one element selected from a rare earth metal including Sc and Y and present in an amount of 29 wt. %≤R≤35 wt. %. The composition also includes T being at least one element selected from Fe and Co and present in an amount of 62 wt. %≤T≤70 wt. %. B in the composition is defined as Boron and is present in an amount of 0.9 wt. %≤B≤1.2 wt. %. The composition further includes M being at least one element selected from Ti, Ni, Nb, Al, V, Mn, Sn, Ca, Mg, Pb, Sb, Zn, Si, Zr, Cr, Cu, Ga, Mo, W, and Ta and present in an amount of 0.1 wt. %≤M≤1.8 wt. %.

The method includes a first step of casting the R-T-B-M raw materials to produce an alloy sheet. To cast the R-T-B-M raw materials, the R-T-B-M raw materials are first melted and a strip casting process can be used to produce the alloy sheet directly from its molten state. Alternatively, instead of strip casting process, an ingot casting process may be used to produce the alloy sheet. The next step of the method is subjecting the alloy sheet to a hydrogen atmosphere in a hydrogen decrepitation process at an absorption pressure of at least 0.1 MPa to expand and break-up the alloy sheets into a powder. In other word, the hydrogen decrepitation process converts the alloy sheet to the powder due to the expansion of the alloy sheet on hydrogen absorption. The step of subjecting the alloy sheets to a hydrogen atmosphere is further defined as applying the absorption pressure between 0.11 MPa and 0.2 MPa thereby increasing the temperature to a range between 400° C. and 600° C. The next step of the method is to remove the hydrogen by degassing the hydrogen from the hydrogen atmosphere. The hydrogen removed from the degassing step is at a temperature range of between 400° C. and 600° C.

The powder produced from the hydrogen decrepitation process is injected into a mill in a stream of inert gas, e.g. Nitrogen or Argon. Powders in the inert gas are milled by using a jet mill process to produce a mixture of particles having an average particle size of no more than 8.0 μm. The next step of the method is to mix the particles with a lubricant. Conventional lubricants such as a fatty ester may be used to mix with the particles. The particles are then molded a block. The step of molding is further defined as orienting the alloy powders using a DC magnetic field having a magnetic strength of between 1.5 T and 2.5 T to produce the block having a density of between 3.5 g/cm$^3$ and 4.5 g/cm$^3$. In other words, the step of orienting the block is performed at the same time as the step of molding. Alternatively, the orienting step may be performed after the molding step.

Next step of the method is applying an isostatic pressure of at least 100 MPa to the block to increase the density of the block. The step of applying the isostatic pressure is further defined as subjecting the blocks to the isostatic pressure of between 100 MPa and 300 MPa to increase the density of the blocks to between 4.0 g/cm$^3$ and 5.0 g/cm$^3$. The blocks are heated at a predetermined sintering temperature of between 900° C. and 1040° C. to further densify the blocks. After sintering the block, the block is aged at a cooler temperature than the predetermined sintering temperature and over a predetermined time to harden the block. The aging step being further defined as aging the blocks at a first curing temperature of between 800° C. and 900° C. followed by curing the blocks at a second curing temperature of between 400° C. and 600° C.

The present invention further provides a step of creating an inert gas environment such as under Argon or Nitrogen gas in the steps of casting, milling, mixing, molding, heating, and aging to prevent the powder from reacting with the oxygen in anyone of the above mentioned steps. By creating an inert gas environment, the present invention limits the exposure of the rare earth elements to oxygen thereby increasing the coercivity of a permanent rare earth magnet.

Obviously, many modifications and variations of the present invention are possible in light of the above teachings and may be practiced otherwise than as specifically described while within the scope of the appended claims. These antecedent recitations should be interpreted to cover any combination in which the inventive novelty exercises its utility.

What is claimed is:

1. A method for producing an R-T-B-M sintered magnet having an oxygen content of less than 0.07 wt. % from R-T-B-M raw materials having R being at least one element selected from a rare earth metal including Sc and Y and present in an amount of 29 wt. %≤R≤35 wt. %, T being at least one element selected from Fe and Co and present in an amount of 62 wt. %%≤T≤70 wt. %, B being Boron and present in an amount of 0.9 wt. %≤B≤1.2 wt. %, M being at least one element selected from Ti, Ni, Nb, Al, V, Mn, Sn, Ca, Mg, Pb, Sb, Zn, Si, Zr, Cr, Cu, Ga, Mo, W, and Ta, said method comprising the steps of;

melting the R-T-B-M raw materials into a molten alloy, forming the molten alloy into an alloy sheet, subjecting the alloy sheet to a hydrogen atmosphere in a hydrogen decrepitation process to expand and break-up the alloy sheet into a powder, degassing the hydrogen from the hydrogen atmosphere, injecting the powder into a mill in a stream of inert gas, milling the powder in the inert gas to produce a mixture of particles having an average particle size of no more than 8.0 μm, mixing the particles with a lubricant, molding the particles into a block, said step of molding the particles into a block being further defined as orienting the alloy powders using a DC magnetic field having a magnetic strength of between 1.5 T and 2.5 T to produce the block having a density between 3.5 g/cm3 and 4.5 g/cm3, applying an isostatic pressure of at least 100 MPa to the block to increase the density of the block, said step of applying the isostatic pressure being further defined as subjecting the block to the isostatic pressure of no more than 300 MPa to increase the density of the block to between 4.0 g/cm3 and 5.0 g/cm3, heating the block at a predetermined sintering temperature to further densify the block, said step of heating the block at a predetermined sintering temperature being further defined as sintering the block at the predetermined sintering temperature of between 900° C. and 1040° C., aging the block at a cooler temperature lower than the predetermined sintering temperature and over a predetermined time to harden the block, and creating an inert gas or nitrogen environment in said step of melting and said step of forming and said step of milling and said step of mixing and said step of molding and said step of heating and said step of aging to prevent the powder from reacting with the oxygen in any one of said steps.

2. A method as set forth in claim 1 wherein said step of melting the R-T-B-M raw materials into a molten alloy occurs prior to said step of subjecting the alloy sheet to a hydrogen atmosphere in a hydrogen decrepitation process and said step of milling the powders and said step of molding the particles and said step of heating the block and said step of aging the block.

3. A method as set forth in claim 2 wherein said step of melting the R-T-B-M raw materials into an alloy includes utilizing an ingot casting process or a strip casting process, and wherein melting the R-T-B-M raw materials takes place in a vacuum condition or with the R-T-B-M raw materials protected with inert gas.

4. A method as set forth in claim 2 wherein said step of subjecting the alloy sheet to a hydrogen atmosphere in a hydrogen decrepitation process is at an absorption pressure of at least 0.1 MPa and a dehydrogenation temperature of between 400° C. and 600° C.

5. A method as set forth in claim 1 wherein said step of aging is further defined as aging the block at a first curing temperature of between 800° C. and 900° C. followed by curing the block at a second curing temperature of between 400° C. and 600° C., and wherein step of aging takes place in a vacuum condition or while protected with an inert gas.

* * * * *